US005448253A

United States Patent [19]

Ponce de Leon et al.

[11] Patent Number: 5,448,253

[45] Date of Patent: Sep. 5, 1995

[54] ANTENNA WITH INTEGRAL TRANSMISSION LINE SECTION

[75] Inventors: Lorenzo A. Ponce de Leon, Lake Worth; Nick Buris, Boca Raton; Kazimierz Siwiak, Coral Springs, all of Fla.

[73] Assignee: Motorola, Inc., Schaumburg, Ill.

[21] Appl. No.: 141,175

[22] Filed: Oct. 25, 1993

[51] Int. Cl.[6] ..... H01Q 1/24; H01Q 9/38

[52] U.S. Cl. ..... 343/702; 343/791; 343/828; 343/829; 343/861

[58] Field of Search ..... 343/828, 829, 702, 790, 343/791, 792, 859, 860, 861; 455/269; H01Q 1/24, 1/50, 9/30, 9/38, 9/40

[56] References Cited

U.S. PATENT DOCUMENTS

| | | | |
|---|---|---|---|
| 2,486,597 | 11/1949 | Greene | 343/792 |
| 3,981,017 | 9/1976 | Kommrusch | 343/792 |
| 4,814,776 | 3/1989 | Caci et al. | 343/702 |
| 4,862,181 | 8/1989 | Ponce de Leon et al. | 343/702 |
| 5,113,196 | 5/1992 | Ponce de Leon et al. | 343/744 |

OTHER PUBLICATIONS

"Reference Data for Radio Engineers", copyright 1968, 1975 by Howard W. Sams and Co., Inc, pp. 24–18, 24–17.

"The ARRL Antenna Book", copyright 1988 by The American Radio Relay League, pp. 16–21–16–26.

*Primary Examiner*—Michael C. Wimer

*Attorney, Agent, or Firm*—Kelly A. Gardner; John H. Moore; Daniel K. Nichols

[57] ABSTRACT

An antenna (105) for receiving radio frequency (RF) signals includes a conductive element (300) having a first electrical length and a first operating impedance and a transmission line (315) having a second electrical length and a second operating impedance for resonating the conductive element (300) at a predetermined operating frequency. A coaxial element (305) having a third electrical length is coupled to the conductive element (300) and the transmission line element (315) for converting the first operating impedance to the second operating impedance. When the conductive element (300) is resonated, the first, second, and third electrical lengths are substantially equal to a quarter wavelength or an odd multiple thereof at the predetermined operating frequency.

14 Claims, 4 Drawing Sheets

100

100

ANTENNA WITH INTEGRAL TRANSMISSION LINE SECTION

FIELD OF THE INVENTION

This invention relates in general to radio communication, and more specifically to monopole antennas for receiving radio signals.

BACKGROUND OF THE INVENTION

Conventional paging receivers utilize many types of antennas for receiving signals having specific frequencies. Typically, antenna size and shape varies with both the frequency of the signals the antenna is to receive and the size and shape of the paging receiver which houses the antenna. For instance, in many low frequency applications, such as in the low VHF (very high frequency) bands, the antenna takes the form of a ferrite loop antenna connected to the receiver. In the UHF (ultra high frequency) band, antennas are often wireform loop antennas or dipole antennas. In each case, however, the antenna must not only function electrically, but also physically fit into the paging receiver.

As technology has advanced, a greater number of features has been included in paging receivers due to customer demands. Many of these features, such as alphanumeric displays, real time clocks and alarms, musical alerts, etc., require a large amount of complex circuitry for implementation, which tends to increase the size of a paging receiver including such features. At the same time, however, market trends have dictated that paging receivers become smaller and lighter such that a user can easily carry a paging receiver without strain or discomfort. These conflicting requirements have necessarily resulted in paging receivers in which the space available for accommodating an antenna has decreased. One solution to this problem is to reduce the size of the antenna. This cannot always be done, however, without adversely affecting the electrical performance of the radio receiver.

In addition to becoming smaller, paging receivers have, in response to customer demand, been manufactured in various form factors for customer convenience. For example, paging receivers have been manufactured in a "credit card" or pen form for carrying in a shirt pocket and a watch form for wearing on the wrist. The number of different form factors in which paging receivers are manufactured is almost limitless, and, for each of these different form factors, antennas must be designed which not only physically fit within the paging receiver, but also function electrically such that the paging receiver can receive the desired signals.

Additionally, antennas which are internal are usually surrounded by components which are not part of the antenna but which can interact with the antenna to reduce its gain and performance. Thus, what is needed is an antenna which can be better isolated from its environment, allowing for compact and internal antenna designs which meet or exceed the performance of conventional antenna designs.

SUMMARY OF THE INVENTION

An antenna for receiving RF signals at a predetermined operating frequency comprising a first elongated conductor and a second elongated conductor having first and second ends opposite each other, wherein the first end of the second elongated conductor is electrically coupled to an end of the first elongated conductor.

A third elongated conductor surrounds the second elongated conductor and has first and second ends, wherein the first end of the third elongated conductor is proximal to the first end of the second elongated conductor and the second end of the third elongated conductor is proximal to the second end of the second elongated conductor and electrically coupled to a ground for the antenna. An insulator located between the second and third elongated conductors provides electrical insulation therebetween. A runner plated on an insulative substrate has a first end electrically coupled to the second end of the second elongated conductor and has a second end electrically coupled to the ground for the antenna. The runner further has a terminal formed between the first and second ends of the runner for providing the RF signals to receiving circuitry.

DESCRIPTION OF A PREFERRED EMBODIMENT

Figure 1:
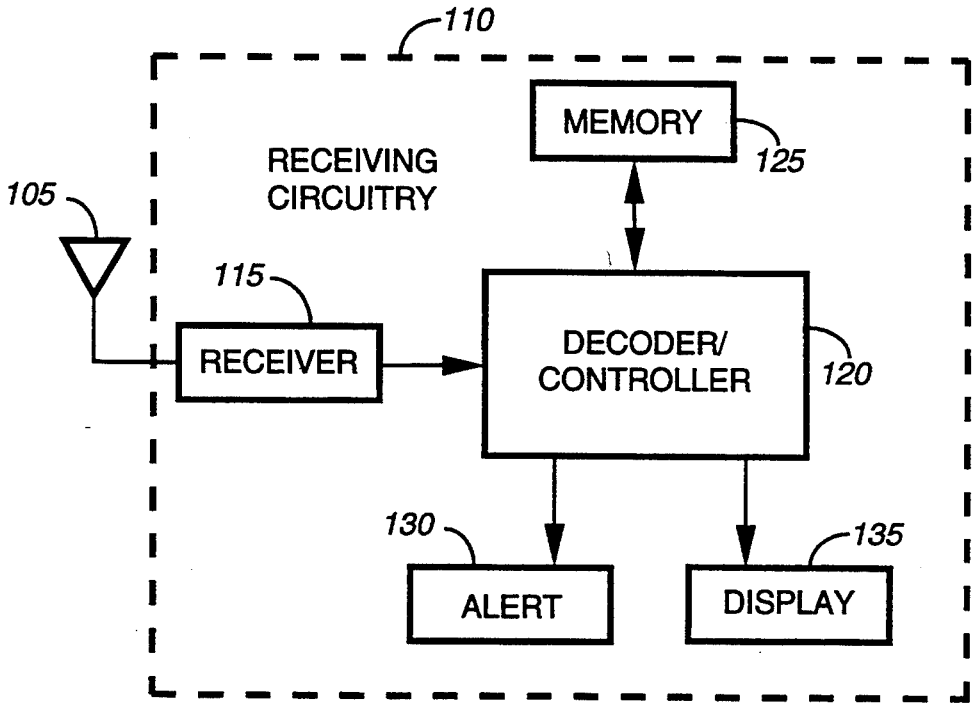
FIG. 1 is an electrical block diagram of a radio receiver in accordance with a preferred embodiment of the present invention.

FIG. I is an electrical block diagram of a radio receiver 100 for receiving radio frequency (RF) signals. The radio receiver 100 comprises an antenna 105 configured for receiving a predetermined range of frequencies and coupled to receiving circuitry 110 for processing the received RF signals provided thereto by the antenna 105. When the radio receiver 100 is a paging receiver, the receiving circuitry 110 typically comprises a receiver 115 for demodulating the received RF signal and a decoder/controller 120 coupled to the receiver 115 for recovering from the demodulated RF signal a selective call message, which is subsequently stored in a memory 125. The receiving circuitry 110 can further comprise an alert mechanism 130 for emitting an audible tone in response to reception of the selective call message and a display 135 for displaying the selective call message to a user.

Figure 2:
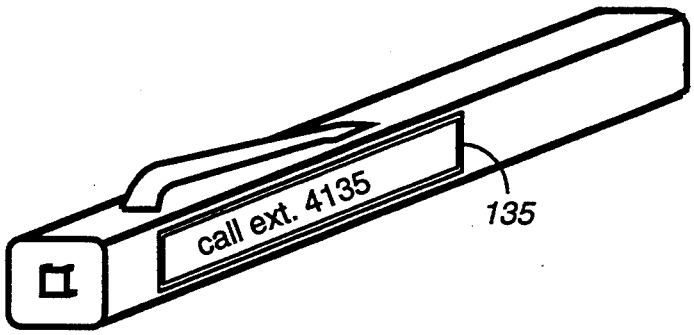
FIG. 2 is an illustration depicting a pen form factor housing in which the antenna included in the radio receiver of FIG. 1 can be embodied in accordance with a preferred embodiment of the present invention.

The radio receiver 100 can be embodied in many different housing form factors designed in response to customer demand. For example, credit card housing form factors have been designed for carrying in shirt pockets, and watch housing form factors have been designed for wearing on the wrist. Additionally, as shown in FIG. 2, the radio receiver 100 can be embodied in a pen housing form factor for clipping to a pocket, belt, or briefcase. In this case, the radio receiver 100, including the antenna 105 and the receiving circuitry 110, must physically fit into a housing which is not only very small, but is also extremely narrow. Consequently, the antenna 105 must be designed to both fit within the housing and function electrically to provide the RF signal to the receiving circuitry 110.

Figure 3:
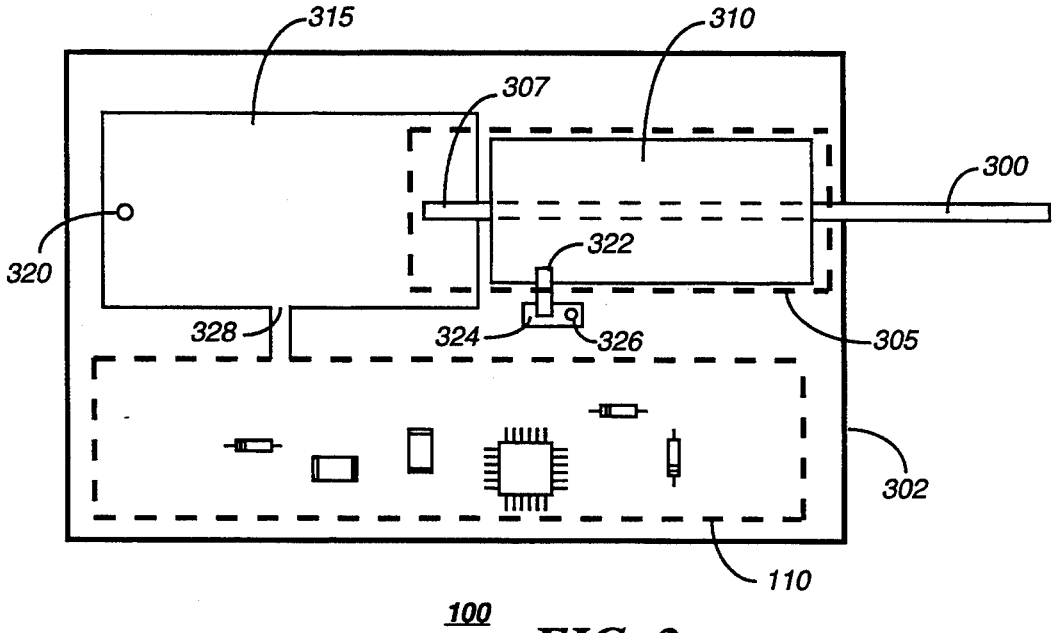
FIG. 3 is a top orthographic view of a substrate and the antenna included in the radio receiver of FIG. 1 in accordance with a preferred embodiment of the present invention.

Referring next to FIG. 3, a top orthographic view of the radio receiver 100, including the antenna 105 (FIG. 1) according to the present invention, is shown. The antenna 105 comprises a first elongated conductor forming a monopole element 300, which is a high impedance element that functions as the primary radiating element of the antenna 105. In accordance with a preferred embodiment of the present invention, the monopole element 300 extends outwards from a substrate, such as a printed circuit board 302 which is typically lossy and which can collect stray signals that sometimes interfere with antenna reception. In alternate embodiments of the present invention, however, the monopole element 300 can be supported by the printed circuit board 302 or an insulative sleeve (not shown) to prevent stress and breakage of the monopole element 300. The energy collected by the monopole element 300 is provided to a coaxial element 305, which preferably extends along the same axis as that along which the monopole element 300 is located. Alternatively, the coaxial element 305 can be bent or manipulated for accommodation within different form factor housings or for layout on different printed circuit board designs. The coaxial element 305 is supported by the printed circuit board 302 and preferably comprises an inner conductor 307, i.e., a second elongated conductor, having a first end electrically coupled to the monopole element 300. Additionally, the coaxial element 305 further includes an outer conductor 310, i.e., a third elongated conductor, which surrounds and is electrically insulated from the inner conductor 307 by an insulator (not shown). The outer conductor 310 is electrically coupled to a ground plane (not shown) for providing a ground potential, e.g., voltage, at an end 312 opposite the monopole element 300. The coaxial element 305 preferably functions as an impedance-converting element. In other words, the coaxial element 305 converts from the high impedance of the monopole element 300 to a lower impedance.

As mentioned above, the first end of the inner conductor 307 is electrically coupled to the monopole element 300. The second end of the inner conductor 307 is electrically coupled to a first end of a transmission line element 315 of the antenna 105. The transmission line element 315 is preferably formed by printed circuit runners plated on top and bottom surfaces of the printed circuit board 302 along the same axis as that along which the monopole element 300 and the coaxial element 305 are formed. The end of the transmission line element 315 which is distant from the coaxial element 305 is preferably coupled to the ground plane, as will be described in greater detail below.

As shown in FIG. 3, the monopole element 300, the coaxial element 305, and the top plate of the transmission line element 315 of the antenna 105 are all extending from, supported by, and formed on, respectively, a first surface of the printed circuit board 302. The ground plane mentioned above is preferably located on a second surface of the primed circuit board 302 opposite the antenna 105. It will be appreciated that the second surface of the printed circuit board 302 can be the other outer layer of the board 302 or, alternatively, an inner layer of a multi-layer printed circuit board. The transmission line element 315 can be electrically coupled to the ground plane in a variety of ways, such as by a wire soldered to the transmission line element 315 and the ground plane or by a one or more holes 320 drilled through the substrate 302 at the appropriate location, then plated to provide coupling between the transmission line element 315 and the ground plane. The outer conductor 310 of the coaxial element 305, which is coupled to the ground plane at the end 312, can also be coupled to the ground plane by a plated hole 326 drilled through the printed circuit board 302. In this situation, the outer conductor 310 can be either soldered directly to a pad 324 on the printed circuit board 302 which is coupled to the ground plane by the plated hole 326, or a ground strap 322 can be electrically connected to both the outer conductor 310 and a pad 324 on the printed circuit board 302 which is coupled to the ground plane by a plated hole 326. According to the present invention, the ground strap 322 and the length of the coaxial element 305 can be advantageously adjusted to optimize antenna performance by varying the resonant frequency of a circuit formed by the outer conductor 310, the ground plane 505, and the interconnect therebetween.

In accordance with the preferred embodiment of the present invention, the transmission line element 315 further comprises a terminal 328 which is electrically coupled to the receiving circuitry 110 to provide received RF signals thereto. When the receiving circuitry 110 is mounted on the first surface of the printed circuit board 302, as shown, the terminal 328 can simply be a printed circuit board runner coupled directly to the receiving circuitry 110. Alternatively, when the receiving circuitry 110 is mounted on the opposite side of the printed circuit board 302, a plated hole (not shown) can be utilized to electrically couple the receiving circuitry 110 to the transmission line element 315. When the receiving circuitry 110 is not mounted on the printed circuit board 302 at all, an actual connector, e.g., a coaxial connector, can be employed as the terminal 328. The position of the terminal 328 along the length of the transmission line element 315 is primarily determined by the driving impedance of the receiving circuitry 110, as will be described in greater detail below.

Figure 4:
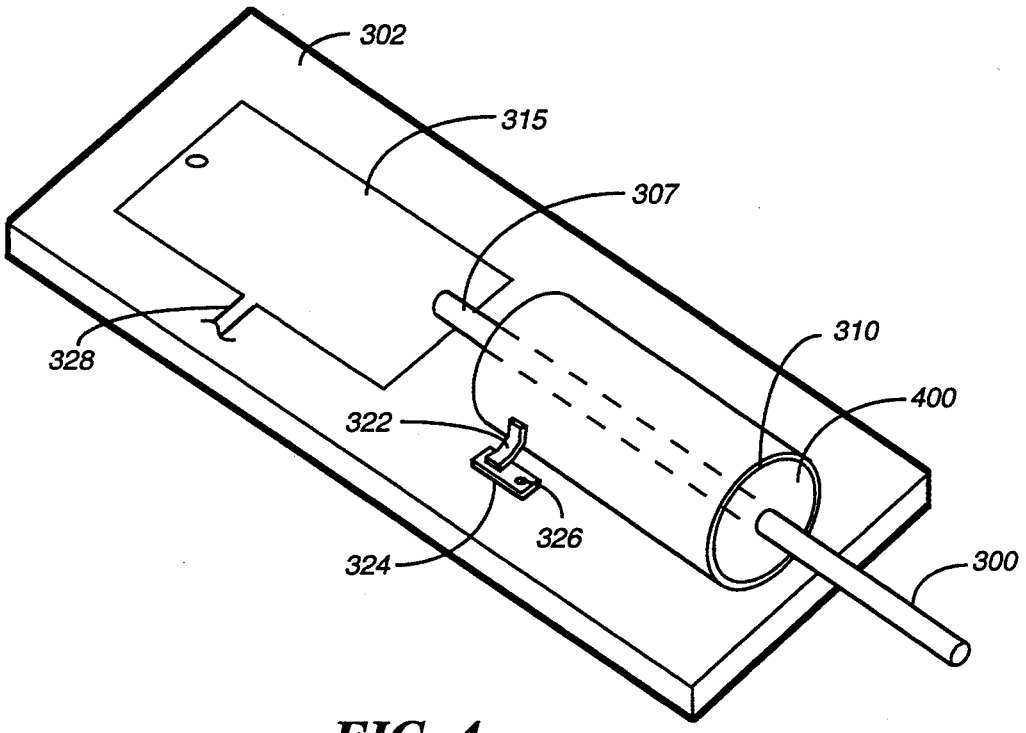
FIG. 4 is a partial perspective view of the antenna of FIG. 3 in accordance with a preferred embodiment of the present invention.

FIG. 4 is a partial perspective view of the antenna 105 (FIG. 1) in accordance with the preferred embodiment of the present invention. As shown, the inner conductor 307 of the coaxial element 305 (FIG. 3) is insulated from the outer conductor 310 by an insulator 400 surrounding the inner conductor 307. The inner conductor 307 is coupled to the monopole element 300 at a first end and to the transmission line element 315 at the opposite end.

The monopole element 300, the inner conductor 307 of the coaxial element 305, the insulator 400, and the outer conductor 310 can all be formed from a conventional coaxial line. When a conventional coaxial line is utilized, a predetermined length of the outer conductor 310 is simply stripped from the coaxial line, thereby forming a first elongated conductor, i.e., the monopole element 300. It will be appreciated that, for support reasons, the insulator 400 of the coaxial line can, if necessary, be left in place around the monopole element 300 without significantly affecting the electrical performance of the antenna 105.

Alternatively, the monopole element 300 and the inner conductor 307 of the coaxial element 305 can be formed from a single wire, such as a conventional beryllium copper wire. When a standard wire is utilized to form the monopole element 300 and the inner conductor 307, an end is preferably plated with tin or another solderable material such that the inner conductor 307 can be easily soldered, or electrically connected in another way, to the transmission line element 315. In this situation, the insulator 400 can be a pre-formed cylinder of insulating material which is slipped over the wire serving as the inner conductor 307. The insulating material should be a low loss dielectric material, such as polyethylene. The outer conductor 310 can be formed either by plating the exterior of the insulator 400 with a low resistance conductive material, such as copper, or by surrounding the insulator 400 with a pre-formed low resistance, conductive cylinder. The ground strap 322 for coupling the outer conductor 310 to the ground plane, via a pad 324 and a plated hole 326, can be manufactured from any low resistance conductor, then soldered to both the outer conductor 310 and the pad 324. Alternatively, the ground strap 322 could be eliminated entirely if the outer conductor 310 is formed such that it can be directly soldered to the pad 324.

In accordance with the preferred embodiment of the present invention, the transmission line element 315 comprises metallization, such as copper, plated onto the printed circuit board 302 in accordance with conventional printed circuit board plating techniques. As described above, the inner conductor 307 can be electrically coupled to the transmission line element 315 in a number of ways, such as by soldering or welding.

Figure 5:
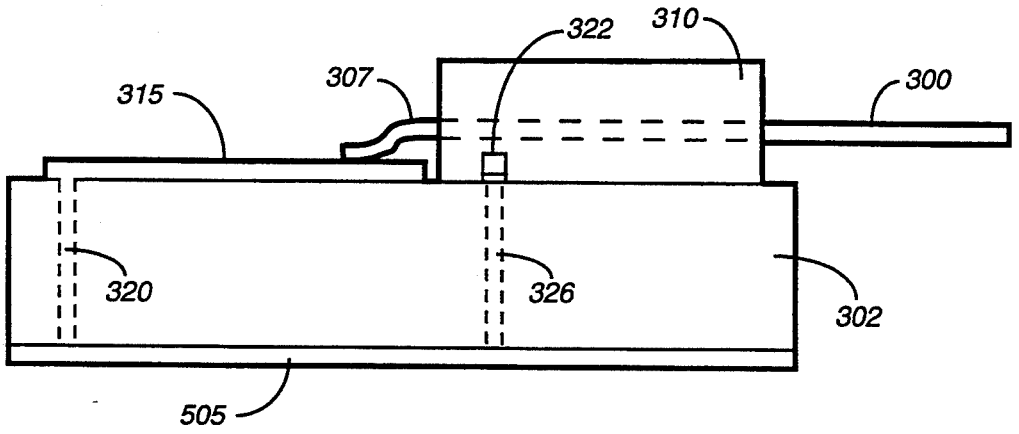
FIG. 5 is a side view of the antenna of FIG. 3 in accordance with a preferred embodiment of the present invention.

Referring next to FIG. 5, a side view of the antenna 105 (FIG. 1) and the printed circuit board 302 is depicted. In accordance with the preferred embodiment of the present invention, the printed circuit board 302 has printed thereon a ground plane 505 on the surface opposite the antenna elements. The ground plane 505 is printed on the printed circuit board 302 using conventional techniques and methods and is coupled to different portions of the antenna 105, such as by the plated holes 320, 326. As shown, the plated hole 320 is drilled through the printed circuit board 302 at the far end of the transmission line element 315, then plated with a conductive material to electrically couple the far end of the transmission line element 315 to the ground plane 505. Additionally, a second plated hole 326 is drilled through the printed circuit board 302 at the end of the outer conductor 310 near the transmission line element 315. The second plated hole 326 electrically couples a pad 324 (FIG. 4) to the ground plane 505. As mentioned above, a ground strap 322 can be utilized to electrically connect the outer conductor 310 to the pad 324.

Figure 6:
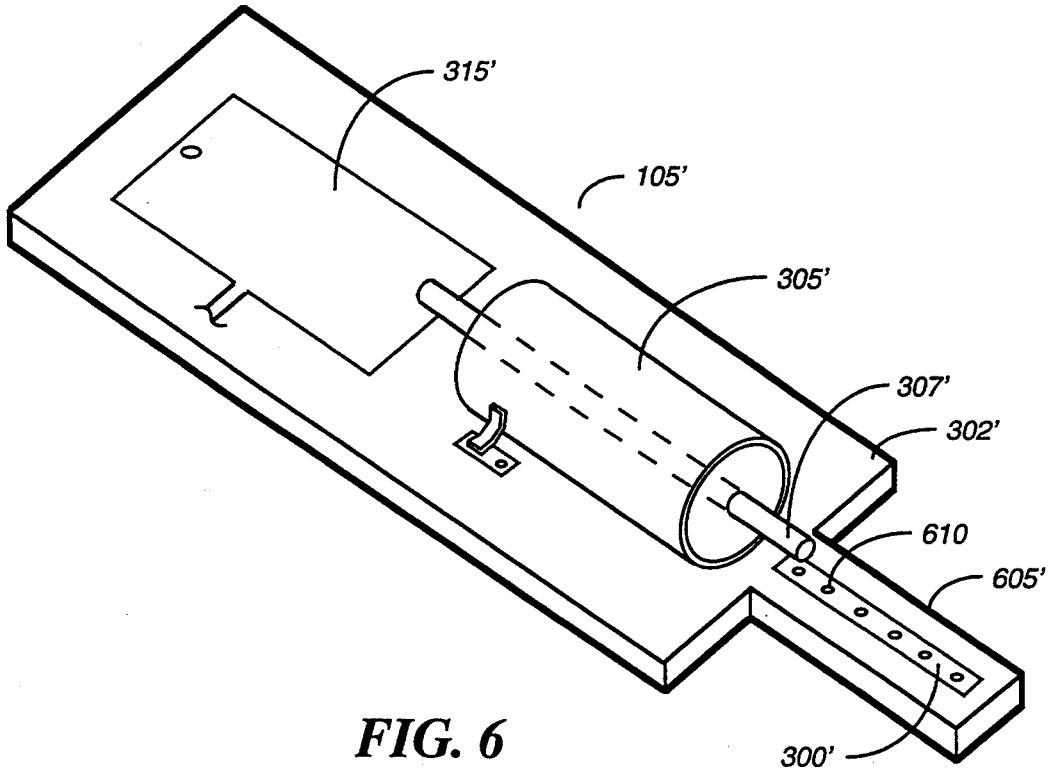
FIG. 6 is a perspective view of an antenna in accordance with an alternate embodiment of the present invention.

FIG. 6 is a perspective view of the antenna 105' in accordance with an alternate embodiment of the present invention. As shown, the printed circuit board 302' for this alternate embodiment includes an extension 605 on which a printed circuit board runner is plated which serves as the monopole element 300'. For better performance, the monopole element 300' further includes a printed circuit board runner (not shown) plated on the opposite surface of the printed circuit board extension 605, which reduces losses. The two runners forming the monopole element 300' are preferably coupled by a plurality of plated holes 610. According to the alternate embodiment of the present invention, the inner conductor 307' of the coaxial element 305' is soldered at a first end to the monopole element 300', as shown, and at a second end to the transmission line element 315'. The use of this alternate embodiment simplifies manufacturing of the antenna 105'.

It will be appreciated that FIGS. 1–6 are not shown to scale; rather, FIGS. 1–6 are depicted in a manner which facilitates understanding of the antenna 105.

The different elements of the antenna 105 can be initially designed using the following formulas as guidelines:

$$\lambda_o = \frac{c}{f} \tag{1}$$

$$l_1 + l_2 + l_3 \leqq \frac{m\lambda_o}{4}, \text{ where } m \text{ is an odd integer,} \tag{2}$$

$$l_2 \neq \frac{n\lambda_o}{2}, \text{ where } n \text{ is an odd integer that is not equal to one (1),} \tag{3}$$

$$l_3 \approx l_1 + l_2 \tag{4}$$

$$R_b = \frac{m\pi z_{o,t}}{4Q} \tag{5}$$

$$R_b = \left(\frac{z_{o,t}^2}{R}\right)\sin^2\theta_1 \tag{6}$$

$$l_1 \geqq \frac{\theta_1}{2\pi}\lambda_d \tag{7}$$

$$z_{o,c} = \left(\frac{138}{\sqrt{\epsilon}}\right)\log_{10}\left(\frac{D}{d}\right) \tag{8}$$

$$z_{o,t} = \frac{377}{2\pi\sqrt{\frac{\epsilon_r+1}{2}}}\left[\ln\left(\frac{8h}{W}\right) + \frac{1}{8}\left(\frac{W}{2h}\right)^2 - \frac{(\epsilon_r-1)}{(\epsilon_r+1)}\left\{\ln\left(\frac{\pi}{2}\right) + \left(\frac{1}{\epsilon_r}\right)\ln\left(\frac{4}{\pi}\right)\right\}\right] \tag{9}$$

$$\epsilon_{re} = \left(\frac{z_{o,t} \text{ for } \epsilon_r = 1}{z_{o,t}}\right)^2 \tag{11}$$

The variables and symbols included in each of formulas 1–9 are described below.

| SYMBOL | DESCRIPTION |
|---|---|
| D | diameter of outer conductor 310 |
| d | diameter of inner conductor 307 |
| $\epsilon$ | dielectric constant of insulator 400 |
| $\epsilon_{re}$ | effective dielectric constant |
| $Z_{o,c}$ | characteristic impedance of coaxial element 305 |
| $\epsilon_r$ | dielectric constant of substrate (printed circuit board 302) |
| W | width of transmission line element 315 |
| h | thickness of substrate (printed circuit board 302) between transmission line element 315 and ground plane 505 |
| $Z_{o,t}$ | characteristic impedance of transmission line element 315 |
| $\theta_1$ | length of transmission line element 315 in radians |
| R | driving impedance of receiving circuitry 110 |
| $R_b$ | modified driving impedance of receiving circuitry 110 |

-continued

| SYMBOL | DESCRIPTION |
|---|---|
| Q | quality factor of antenna 105 |
| c | speed of light ($3 \times 10^8$ meters/second) |
| f | frequency at which antenna 105 is to receive RF signals |
| $\lambda_o$ | wavelength of RF signal in free space |
| $\lambda_d$ | wavelength of RF signal in dielectric |
| $l_1$ | length of transmission line element 315 |
| $l_2$ | length of coaxial element 305 |
| $l_3$ | length of monopole element 300 |

It will be appreciated that these formulas presented above merely describe a starting point for the theoretical design of the antenna 105, and that experimentation is usually required to achieve the final design of an antenna 105 having optimum performance.

Design example referring to formulas 1–9 and the table of variables therefor:

The dimensions of the antenna 105 can be calculated using formulas 1–9 given values for the characteristic impedance ($Z_{o,c}$) of the coaxial element 305, the characteristic impedance ($Z_{o,t}$) of the transmission line element 315, the diameter (D or d) of either the inner conductor 307 or the outer conductor 310, the dielectric constant ( ) of the insulator 400, the dielectric constant ( $_r$) of the printed circuit board 302, the thickness (h) of the printed circuit board 302 between the ground plane 505 and the transmission line element 315, the quality factor (Q) of the antenna 105, the driving impedance (R) of the receiving circuitry 110, and the frequency (f) at which the antenna 105 is to receive RF signals. By way of example, the dimensions of the antenna 105 can be calculated if the following values are known:

$Z_{o,c}=Z_{o,t}=50\Omega$,
d=0.0254 centimeters (cm),
=2.2,
$_r$=4.5
h=0.0762 cm,
Q=30,
R=50Ω, and
f=930 Megahertz (MHz).

Using formula (1), it can be seen that the free space wavelength λ is approximately equal to 32.26 centimeters (cm) as calculated using the speed of light ($c=3\times10^8$ meters/second) and a frequency of 930 MHz. Next a length is chosen for one of the lengths, i.e., a length for either the monopole element 300, the coaxial element 305, or the transmission line element 315. For example, the length $l_1$ of the transmission line element 315 can be chosen to equal one/half (0.5) cm, which corresponds to an electrical length, i.e., the length at which the transmission line element 315 resonates, of 0.028λ at 930 MHz. In this case, applying formula (2) and using $l_1=0.5$ cm and λ=32.26 cm, it can be seen that the lengths of the transmission line element 315, the coaxial element 305, and the monopole element 300 together are preferably less than or equal to eight (8) cm when m=1. To satisfy the condition for resonance, the length of the monopole element 300 could be chosen to be 3.6 cm, which corresponds to an electrical length of 0.111λ, and the length of the coaxial element 305 could be chosen as 2.4 cm, which corresponds to an electrical length of 0.111λ. These choices also fulfill the requirements of formulas (3) and (4). It will be appreciated that the lengths $l_1$, $l_2$, and $l_3$ could have been chosen differently for design reasons and to satisfy formula (1) when m is not equal to one.

Next, formulas (5), (6), and (7) can be used to determine the distance from the plating hole 320 of the transmission line element 315 to the terminal 328 of the transmission line element 315. First, the modified driving impedance is calculated to be approximately 1.3Ω. The length in radians is then found to be approximately 0.163 radians. To translate this length into centimeters, the wavelength in the transmission line element 315 is calculated using (10) and (11). Formula (7) can be used as an equality to calculate the minimum length $l_1$ of the transmission line element 315. Therefore, a simple ratio can be set up to determine that 0.163 radians is approximately equal to 0.45 cm, which is the distance between the plating hole 320 and the terminal 328. The placement of the terminal 328 therefore determines the driving impedance of the receiving circuitry 110.

Additionally, using formula (8), the diameter of the outer conductor 310 can be calculated to be approximately 0.0875 cm. Using formula (9), the width of the transmission line element 315 is calculated to be approximately 0.146 cm.

One of ordinary skill in the art will recognize that the above calculated values are only approximations, and that further modifications in the dimensions may be necessary to optimize the performance of the antenna 105 and thereby account for stray capacitances and inductances which are difficult to calculate.

It can be seen that this design for the antenna 105 in accordance with the preferred embodiment of the present invention offers a tremendous amount of flexibility in selection of the dimensions of the different antenna elements. As a result, the antenna 105 can conveniently be utilized for a variety of different pager form factors. In particular, the antenna 105 according to the present invention is especially suitable for use in a radio receiver 100 (FIG. 1) manufactured in a pen housing form factor because the antenna 105 is rather narrow.

A further feature of the antenna 105 according to the preferred embodiment of the present invention is that the receiver terminal 328 (FIG. 3) of the transmission line element 315 can be advantageously located to provide a driving impedance which "matches" to the receiving circuitry 110 to prevent losses and reflections of the RF signals received by the antenna 105. Conventionally, matching circuitry, which can consist of a number of space-consuming components, is electrically coupled between the antenna 105 and the receiving circuitry 110. In accordance with the present invention, however, this additional matching circuitry is unnecessary because the placement of the receiver terminal 328 can simply be changed to account for changes in the receiver circuitry 110 input impedance and components included therein. Consequently, the cost of conventional matching circuitry is saved by using the transmission line element 315.

Additionally, the length of the transmission line element 315 between the coaxial element 305 and the ground terminal, i.e., plated hole 320, can be conveniently varied to tune the center frequency of the RF signal received by the antenna 105. In general, the variation of the center frequency can be accomplished without significantly affecting the driving impedance of the receiving circuitry 110.

Figure 7:
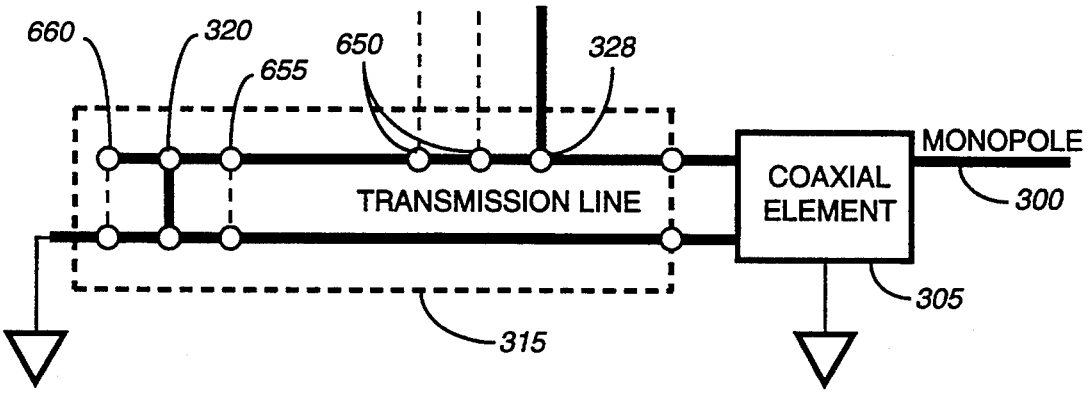
FIG. 7 is an electrical diagram of the antenna of FIG. 3 in accordance with a preferred embodiment of the present invention.

Referring next to FIG. 7, an electrical diagram depicts the movement of the receiver terminal 328 along the length of the transmission line element 315 and the variation of the transmission line length. As described above, the location of the receiver terminal 328 can be varied to change the driving impedance R. One method in which this might be conveniently done is to drill multiple plated holes 328, 650 along the length of the transmission line element 315. The "most correct" via hole 328 for any given frequency could than be chosen by experimentally measuring the driving impedance at each of the holes 328, 650. The holes 650 other than the one chosen to act as the receiver terminal 328 would be disconnected from the receiving circuitry 110 by drilling the metallization from the holes 650, thereby opening the connections.

Additionally, a plurality of plated holes 320, 655, 660 could be formed near the end of the transmission line element 315 to couple the transmission line element 315 to the ground plane 505. The endmost hole 660 would be located such that the highest desired frequency received by the antenna 105 corresponds to the length of the transmission line element 315 when coupled to the ground plane 505 at the location of the hole 660. When tuning the antenna 105 experimentally, the hole 660 would be opened, e.g., by drilling out the metallization, to lower the center frequency of the received signal. This process would be repeated until the length of the transmission line element 315 is such that the antenna 105 is tuned to the desired center frequency by selecting the correct electrical length which resonates at the desired frequency. In this manner, both the driving impedance and the center frequency can be selectively tuned without external tuning components, such as variable capacitors.

Figure 8:
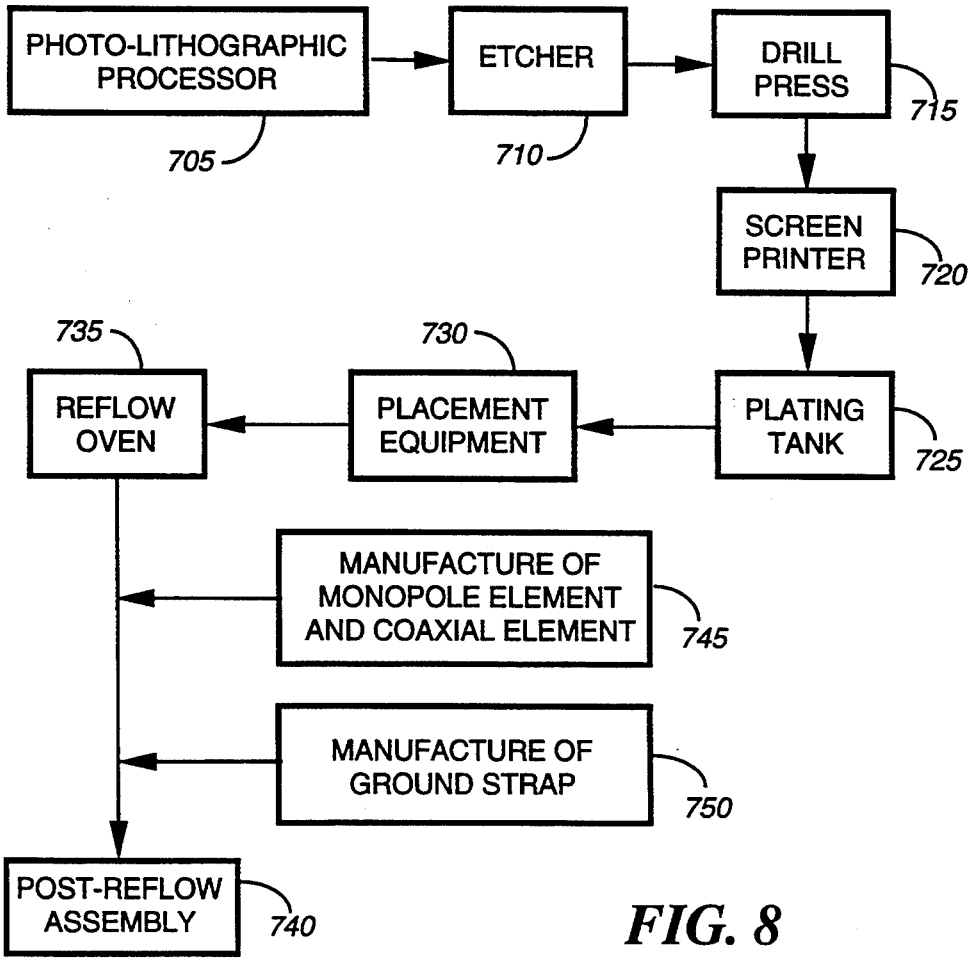
FIG. 8 is a process flow diagram illustrating a method of manufacturing the antenna of FIG. 3 in accordance with a preferred embodiment of the present invention.

Referring next to FIG. 8, a process flow diagram illustrates a process by which the radio receiver 100, including the antenna 105, can be manufactured. The initial step in the construction process involves exposing a photographic image of the printed circuit board runners and pads onto a photo-resist deposited on the printed circuit board 302 (FIG. 3) by use of a device such as a photolithographic processor 705. The transmission line element 315, the pad 324 (FIG. 3), and the terminal 328, if desired, are imprinted during this process. The printed circuit board 302 is manufactured using any one of a number of well known printed circuit board materials, such as FR-4 (a flame retardant classification) or a glass epoxy material. Other materials, including those with higher dielectric constants, can be utilized as well.

Next, the imprinted board 302 is preferably processed by etching equipment 710 to etch metallization from the board 302 as indicated by the printing thereon. This process selectively removes metallization from the board 302 to form the transmission line element 315, the pad 324, the terminal 328, if necessary, and other printed circuitry. Subsequently, a drill press 715 is employed to drill holes, such as the holes 320, 326 (FIG. 3), through the board 302 in designated locations, after which a screen printer 720 selective laminates the board 302 to apply a non-conductive material, such as solder resist, thereon. During this process, selected metallized areas, for example, holes 320, 326, the pad 326, and the area of the transmission line element 315 to which the inner conductor 307 is to be soldered, are not laminated. The exposed metallized areas of the board 302 are thereafter plated with a conductive material in a plating tank 725. In this manner, different areas of the printed circuit board 302 which are connected by the drilled holes can be electrically coupled by the plating which flows therethrough.

When the receiving circuitry 110 is to be mounted on the board 302 in an automated process, the board 302 is next processed by placement equipment 730 for automatically placing receiving components on the appropriate component pads, which have been exposed to the plating. A reflow over 735 is them employed to apply heat to the board 302 to reflow the metallization between the receiver components and the component pads, thereby securing the receiving circuitry 110 to the board 302.

Subsequently, the board 302 is processed in post-reflow processes 740, in which components not suitable for reflow are attached to the board 302. During this process, the monopole element 300 and the coaxial element 305, which could have been previously constructed in an antenna manufacturing process 745, are soldered to the transmission line element 315 at the end of the inner conductor 307. Additionally, the ground strap 322, which, if necessary to the antenna design, has been previously manufactured in a forming and cutting process 750, is soldered to the pad 324 and the outer conductor 310 of the coaxial element 305.

In summary, the antenna as described above comprises three elongated elements formed along a single axis. Therefore, the antenna is especially suitable for use in narrow form factor radio receiver housings, such as pen form factor pagers, having tight space constraints. Additionally, a third of the elongated elements, i.e., the transmission line element, can be formed directly on a printed circuit board to which receiving circuitry is mounted. Consequently, this element is not separately manufactured, stocked, or assembled, which reduces the cost of the radio receiver.

This transmission line element, furthermore, conveniently performs the function of a conventional matching network. More specifically, the transmission line element is coupled to other antenna elements at one end and to the ground plane at the other end. A terminal formed between the two ends couples to the receiving circuitry for providing the RF signals thereto. The placement of this terminal advantageously determines the driving impedance of the receiving circuitry. As a result, for different receiving circuitry and components, the terminal can simply be relocated to match to the receiving circuitry and provide optimum receiver performance, and space-consuming conventional matching components are eliminated.

Additionally, the frequency of the received RF signal can be adjusted, or tuned, by simply increasing or decreasing the length of the transmission line element. Provisions for the tuning of the antenna can be conveniently made during manufacture of the antenna by drilling a plurality of via holes from the transmission line element to ground. The holes can simply be opened to adjust the length of the transmission line element, and thus the frequency of the received signals.

It may be appreciated by now that there has been provided an antenna which functions electrically in various paging form factors. The antenna eliminates the need for conventional matching and tuning circuitry as well.

What is claimed is:

1. An antenna for receiving RF signals at a predetermined operating frequency, comprising:

a first elongated conductor;

a second elongated conductor having first and second ends opposite each other, wherein the first end of the second elongated conductor is electrically coupled to an end of the first elongated conductor;

a third elongated conductor surrounding the second elongated conductor and having first and second ends, wherein the first end of the third elongated conductor is proximal to the first end of the second elongated conductor and the second end of the third elongated conductor is proximal to the second end of the second elongated conductor and electrically coupled to a ground for the antenna;

an insulator located between the second and third elongated conductors for providing electrical insulation therebetween; and a runner plated on an insulative substrate, the runner having a first end electrically coupled to the second end of the second elongated conductor and having a second end electrically coupled to the ground for the antenna, the runner further having a terminal formed between the first and second ends of the runner for providing the RF signals to receiving circuitry.

2. The antenna according to claim 1, wherein the second and third elongated conductors and the insulator formed therebetween comprise a coaxial element.

3. The antenna according to claim 2, wherein the first elongated conductor, the coaxial element, and the runner have first, second, and third electrical lengths, respectively.

4. The antenna according to claim 3, wherein the sum of the first, second, and third electrical lengths is substantially equal to a quarter wavelength or an odd multiple thereof when the monopole element is resonated at the predetermined operating frequency.

5. The antenna according to claim 4, wherein the first elongated conductor forms a monopole element, and the runner forms a transmission line.

6. The antenna according to claim 5, wherein the first electrical length of the monopole element is substantially equal to the sum of the second and third electrical lengths at the predetermined operating frequency.

7. The antenna according to claim 5, wherein a ground plane for receiving the ground for the antenna is formed on a surface of the insulative substrate opposite the transmission line.

8. The antenna according to claim 7, wherein the transmission line is electrically coupled at the second end thereof to the ground plane by a plated hole.

9. The antenna according to claim 8, wherein the plated hole can be positioned at different locations along the transmission line to vary the predetermined operating frequency.

10. The antenna according to claim 8, wherein the receiving circuitry is characterized by a receiver impedance, and the terminal can be positioned at different locations along the transmission line to match to the receiver impedance.

11. A radio receiver for receiving and processing radio frequency signals at a predetermined operating frequency, the radio receiver comprising:

receiving circuitry for processing the radio frequency signals; and an antenna for providing the radio frequency signals to the receiving circuitry, the antenna comprising:

a monopole element having a first electrical length and a first operating impedance;

a transmission line having a second electrical length and a second operating impedance for resonating the monopole element at the predetermined operating frequency;

a coaxial element having a third electrical length and coupled between the monopole element and the transmission line element for converting the first operating impedance to the second operating impedance;

a receiver terminal electrically coupled between the transmission line and the receiving circuitry for providing the radio frequency signals to the receiving circuitry; and wherein, when the monopole element is resonated at the predetermined operating frequency, the sum of the first, second, and third electrical lengths is substantially equal to a quarter wavelength or an odd multiple thereof.

12. The radio receiver according to claim 11, wherein the receiving circuitry is characterized by a receiver impedance, and the receiver terminal can be positioned at different locations along the transmission line to match from the second operating impedance to the receiver impedance.

13. The radio receiver according to claim 26, wherein the transmission line comprises a runner formed on an insulative substrate and coupled to a ground for the antenna.

14. The radio receiver according to claim 13, wherein the runner can be coupled to the ground for the antenna at different locations to vary the predetermined operating frequency.

* * * * *

UNITED STATES PATENT AND TRADEMARK OFFICE

CERTIFICATE OF CORRECTION

PATENT NO. : 5,448,253

DATED : September 5, 1995

INVENTOR(S) : Lorenzo A. Ponce de Leon, et. al.

It is certified that error appears in the above-identified patent and that said Letters Patent is hereby corrected as shown below:

Column 12, line 41, after claim delete "26" and insert --11--.

Signed and Sealed this

Nineteenth Day of December, 1995

*Attest:*

*Attesting Officer*

BRUCE LEHMAN

*Commissioner of Patents and Trademarks*